US005868658A

United States Patent [19]

Wild

[11] Patent Number: 5,868,658

[45] Date of Patent: Feb. 9, 1999

[54] METHOD OF AND APPARATUS FOR PRODUCING BEVERAGE CONTAINERS

[75] Inventor: Rainer Wild, Eppelheim, Germany

[73] Assignees: Deutsche SiSi-Werke GmbH & Co.; Betriebs KG, both of Germany

[21] Appl. No.: 574,264

[22] Filed: Dec. 18, 1995

[30] Foreign Application Priority Data

Dec. 22, 1994 [DE] Germany ..... 44 46 104.6

[51] Int. Cl.[6] ..... B31B 1/90

[52] U.S. Cl. ..... 493/212; 53/359; 493/196; 493/936

[58] Field of Search ..... 53/346; 493/212, 493/218, 219, 193, 194, 195, 196, 197, 936, 204, 213, 210; 220/270, 359

[56] References Cited

U.S. PATENT DOCUMENTS

| | | | |
|---|---|---|---|
| 4,631,905 | 12/1986 | Maloney | 493/196 |
| 4,783,950 | 11/1988 | Santagati | 53/75 |
| 4,885,897 | 12/1989 | Gryouda et al. | 53/432 |
| 4,986,859 | 1/1991 | Watanabe | 493/103 |
| 5,147,272 | 9/1992 | Richison et al. | 493/195 |
| 5,244,450 | 9/1993 | Koehn | 493/195 |
| 5,254,073 | 10/1993 | Richison et al. | 493/193 |
| 5,269,123 | 12/1993 | Marchesini | 53/75 |
| 5,287,681 | 2/1994 | Vernon et al. | 53/450 |
| 5,465,549 | 11/1995 | Lummus | 53/75 |
| 5,571,361 | 11/1996 | Stuerzel | 493/197 |

FOREIGN PATENT DOCUMENTS

| | | |
|---|---|---|
| 1 262 762 | 3/1968 | Germany . |
| 29 31 850 | 2/1981 | Germany . |
| 3422679A1 | 8/1985 | Germany . |
| 4240540A1 | 8/1994 | Germany . |

*Primary Examiner*—W. Donald Bray
*Assistant Examiner*—John Paradiso
*Attorney, Agent, or Firm*—Tilton, Fallon, Lungmus & Chestnut

[57] ABSTRACT

The invention relates to a method of and an apparatus for producing beverage containers.

For making beverage containers having a piercable through-hole for a straw in their front sheeting, which is sealed on the inside of the front sheeting by means of a closure strip, a piercing hole is formed in a front side sheeting web conveyed in conveying direction, whereafter a closure sheeting web is fed in conveying direction to the front side sheeting web and is then sealed around the piercing hole to the inside of the front side sheeting web. A rear side sheeting web is supplied in conveying direction such that the inside of the front side sheeting web welded to the closure sheeting web moving along with the latter faces the inside of the front side sheeting web. Thereafter, the front side sheeting web and the rear side sheeting web are welded together at least in part along the lateral edges of the beverage container to be produced, with the closure sheeting web being included therein.

12 Claims, 4 Drawing Sheets

METHOD OF AND APPARATUS FOR PRODUCING BEVERAGE CONTAINERS

The invention relates to a method of and apparatus for making beverage containers.

In case of beverage containers having a piercing hole for inserting a straw, one of the greatest problems consists in opening the hole by means of the straw in simple manner. Especially in case of containers filled in a hot sterile state, problems arise upon introduction of the straw, since vapour is present in the head space of the container upon filling thereof, which condenses upon cooling, so that there is hardly any air left in the head space. The consequence thereof is that the piercing hole now is located below the liquid level, so that uncontrolled liquid discharge may occur upon uncareful opening of the container. Due to the fact that the front and rear sides of a beverage container are located relatively close to each other, uncareful piercing may involve the risk that the rear side of the beverage container is pierced as well.

Figure 4:
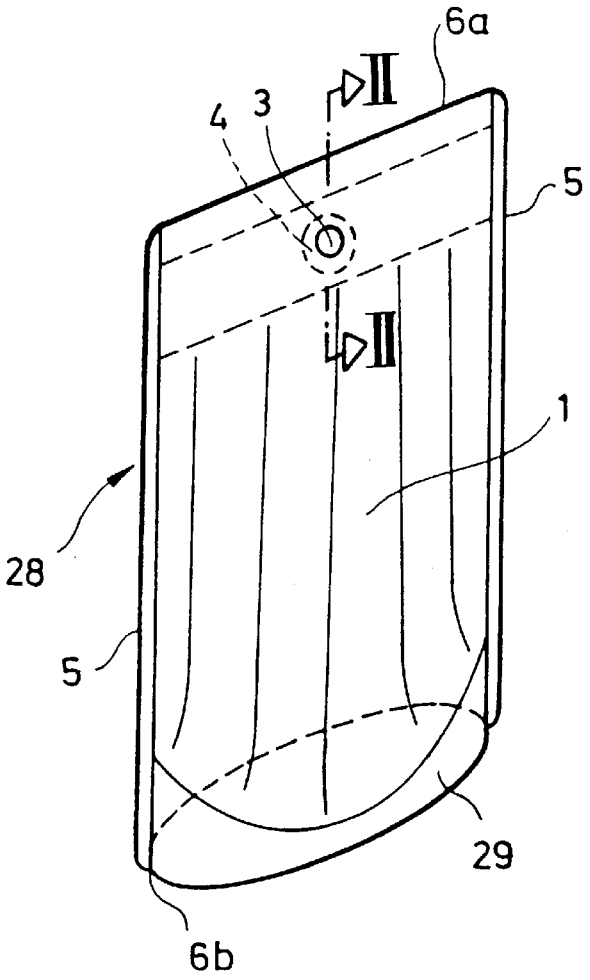
Figure 5:
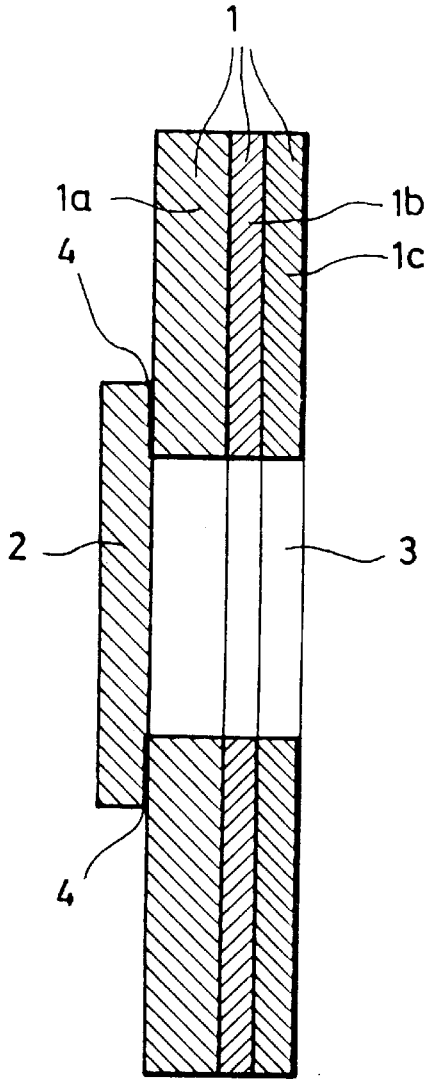

A beverage container free from these disadvantages has already been suggested in DE-OS 4240540.8. In case of such a bag, as shown in FIGS. 4 and 5, the piercing hole 3 is punched through all layers of a mono- or composite material 1*a,b,c* of the front side sheeting 1. The inside of the front side sheeting has a closure sheeting strip 2 welded thereto at a first weld 4 around the piercing hole, so that a tight closure is formed. The closure strip furthermore is held at a second weld between front and rear side sheetings to the lateral seams 5 of the beverage container. The beverage container shown in FIG. 4, in addition thereto, comprises a bottom sheeting part welded between front and rear side sheetings.

However, the application of the additional closure sheeting entails the problem of making such beverage containers in continuous, economic and reliable manner.

The present invention thus has the object of making available a method of and an apparatus for performing the method, which permit a continuous, economic and reliable production of such beverage containers.

According to the invention, this object is met by a method wherein a piercing hole is formed in a front side sheeting web conveyed in conveying direction, whereafter a closure sheeting web is conveyed in conveying direction to the front side sheeting web and then is welded around the piercing hole to the inside of the front side sheeting web, and a rear side sheeting web is supplied in conveying direction such that the inside of the front side sheeting web welded to the closure sheeting web moving along with the latter faces the inside of the rear side sheeting web, and thereafter, the front side sheeting web and the rear side sheeting web are welded together at least in part along the lateral edges of the beverage container to be produced, with the closure sheeting web being included therein. The object is met furthermore by an apparatus for performing the method, comprising a conveying means for a front side sheeting web, a conveying means for a rear side sheeting web, a means for producing a piercing hole through the front side sheeting web, a conveying means for a closure sheeting web, a first sealing means for sealing the closure sheeting web to the inside of the front side sheeting web around the piercing hole, and a second sealing means for sealing the front side sheeting web and the rear side sheeting web at least in part along the lateral edges of the beverage container to be produced, with the closure sheeting web being included therein.

The concept according to the invention allows for a continuous production of beverage containers, in which a closure sheeting web may be supplied intermittently in continuous form. The continuous production flow is not interrupted especially by the application of the closure sheeting, since the closure sheeting web is fed in conveying direction and is welded to the front side sheeting web and moved along with the latter. A further advantage resides in that the closure sheeting web is also held by welding of the lateral edges of the beverage bag, so that an additional lateral welding operation for the closure sheeting web is not necessary any more. Moreover, the closure sheeting web need not be aligned with the front side sheeting web in conveying direction, as it would be necessary e.g. upon application of pre-cut closure sheeting strips. By feeding the front, rear and also the closure sheeting webs separately from each other, it is rendered possible that these sheetings may each be optimized separately from each other. By selection of different material thicknesses, it is thus possible, for example, to adjust the rigidity and flexibility of each individual sheeting in optimum manner. The technology according to the invention offers the advantage that, for example, a print on the rear side sheeting may be dispensed with, so that a working step involving very high costs in foil or sheeting production is saved completely. The production takes place in such precise manner that trimming of the edges of the bags can be dispensed with completely.

It is advantageous that in addition a bottom sheeting web is fed in conveying direction between front and rear side sheeting webs and is welded in part to the front and rear side sheeting webs in the bottom region of the beverage bag to be produced. By such welding-in of a bottom part, it is possible to produce, for example, a standing bag. Due to the fact that the bottom sheeting web is fed in conveying direction as well, the continuous production flow need not be interrupted for welding-in the bottom sheeting web. As the bottom sheeting is also fed separately from the other sheetings, the bottom sheeting may also be optimized independently of the other sheetings.

According to a specific embodiment of the present invention, a specific number of beverage containers to be produced may be provided on the front and rear side sheeting webs beside each other in a direction perpendicular to the conveying direction and, in accordance with this number, a corresponding number of piercing holes may be produced beside each other in the front side sheeting web and a corresponding number of closure sheeting webs may be supplied and welded around the respective piercing holes. In this respect it is also possible, in conformity said number, to supply a corresponding number of bottom sheeting webs and to weld them between front and rear side sheeting webs. This means that several bags can be produced in one machine cycle.

The welded together sheeting webs are then cut into separate beverage containers.

An apparatus for performing the method advantageously comprises, as mentioned hereinbefore, a further conveying means for a bottom sheeting web, which is disposed such that the bottom sheeting web is conveyed between front and rear side sheeting webs in conveying direction, and in addition thereto a third welding means for welding the front and rear side sheeting webs at least in part to the bottom sheeting web in the bottom region of the beverage container to be produced.

A transverse cutter may be provided for cutting the welded together sheeting webs into separate bags.

As mentioned hereinbefore, the front and rear side sheeting webs may have a specific number of beverage containers provided thereon beside each other in a direction perpendicular to the conveying direction, and, in conformity with this number, a corresponding number of conveying means for the closure and bottom sheeting webs and an equal number of means for producing piercing holes as well as an equal number of first and third sealing means are provided. This provides an apparatus having several uses, which in turn increases the productivity of the apparatus.

Moreover, the apparatus may have a longitudinal cutting means for cutting the beverage containers to be produced on the sheeting webs beside each other.

Figure 2:
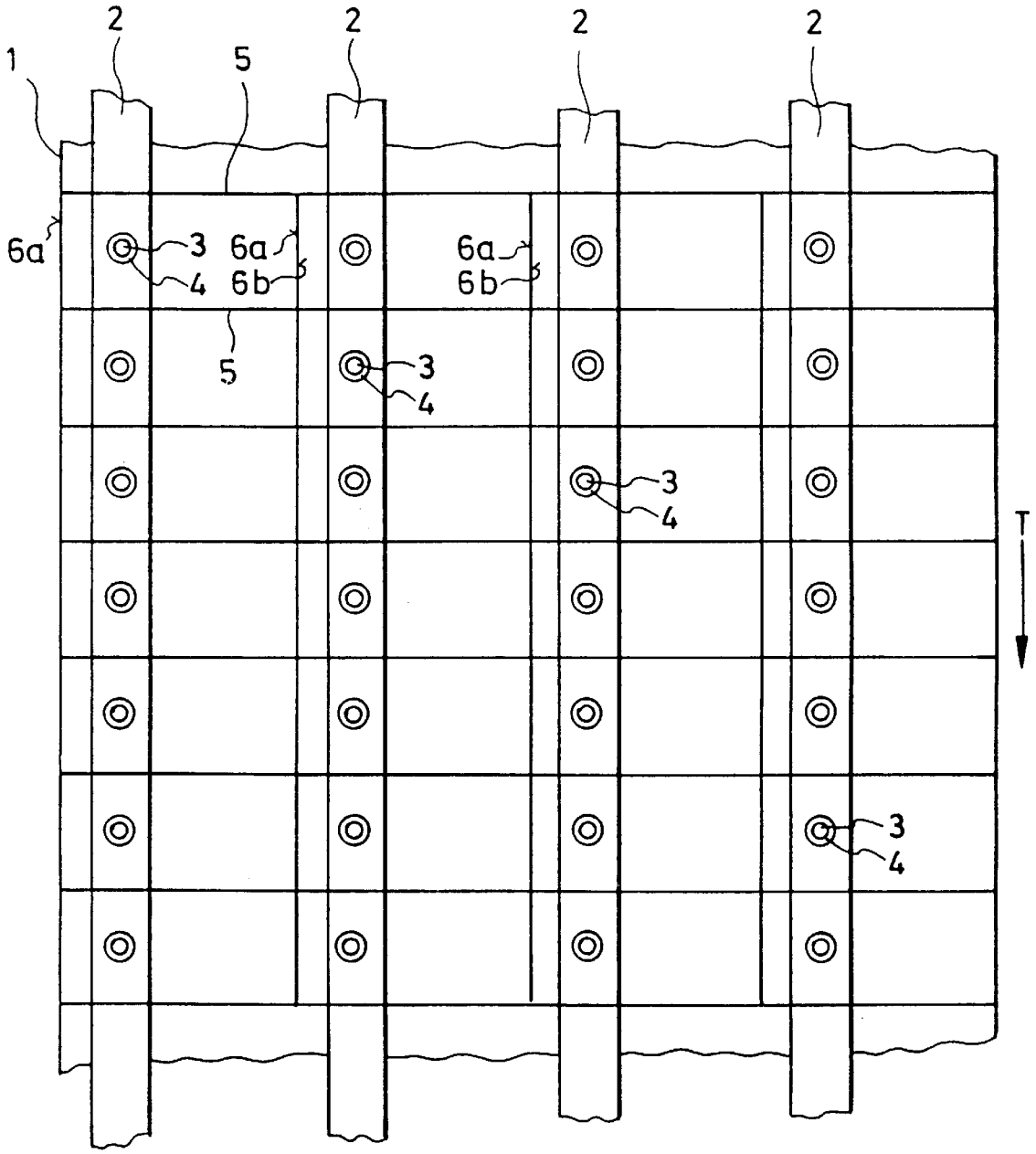
Figure 3:
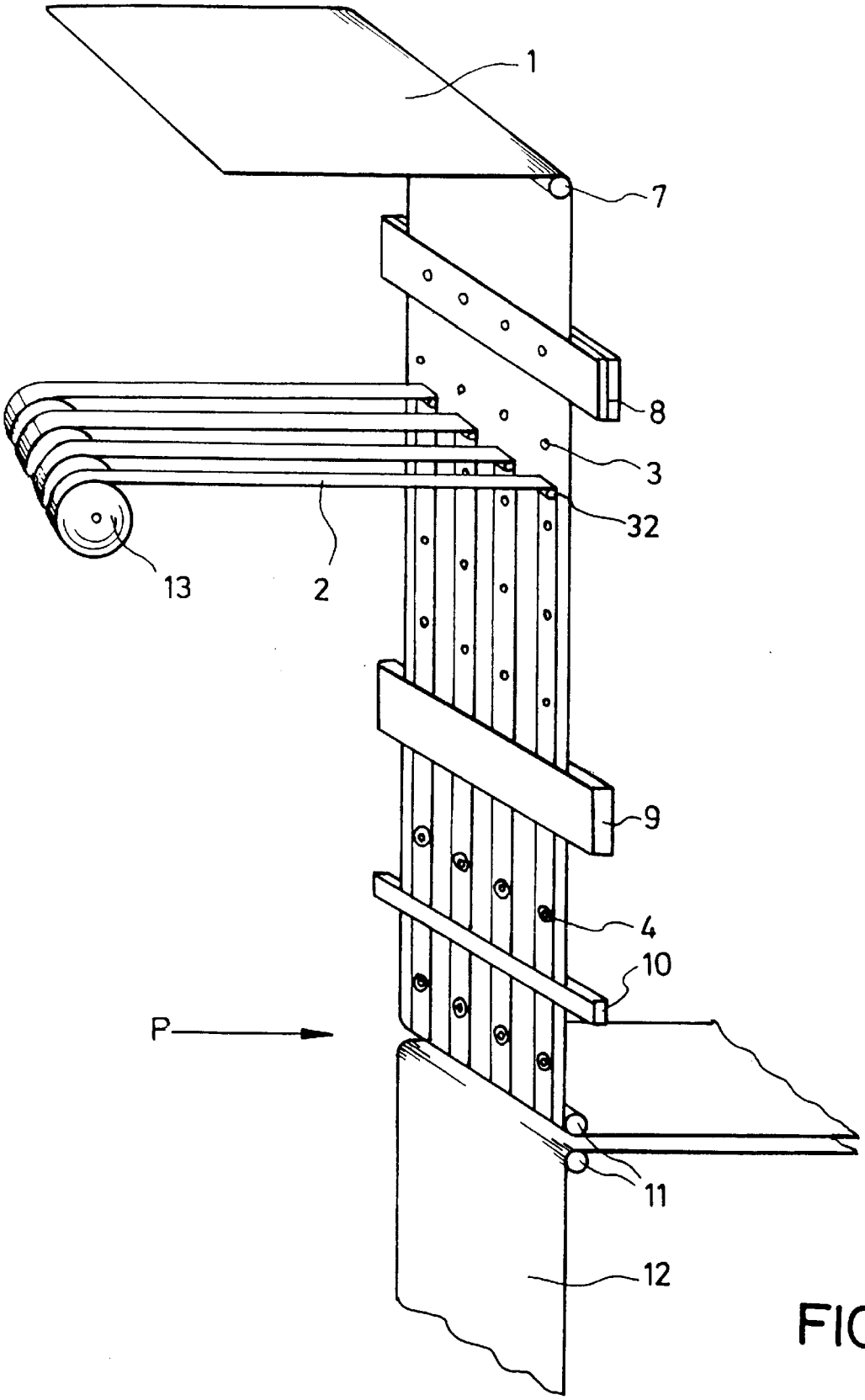

In a preferred embodiment the apparatus further comprises an inspection means downstream of the first sealing means for measuring the differential pressure so as to examine the weld around the piercing hole. The inspection means, during the production operation in progress, monitors the function of the first sealing means, so that a production of bags with an incorrectly re-sealed piercing hole is excluded. The invention shall be elucidated in more detail by way of the drawings listed hereinafter, in which FIG. 1 shows a schematic representation of the apparatus according to the invention, FIG. 2 shows a plan view of a front side sheeting web having closure sheeting webs sealed thereto, FIG. 3 shows a perspective view of a portion of an embodiment of the apparatus according to the invention, FIG. 4 shows a perspective view of a beverage bag to be produced, and FIG. 5 shows a section along the line II—II in FIG. 4.

Figure 1:
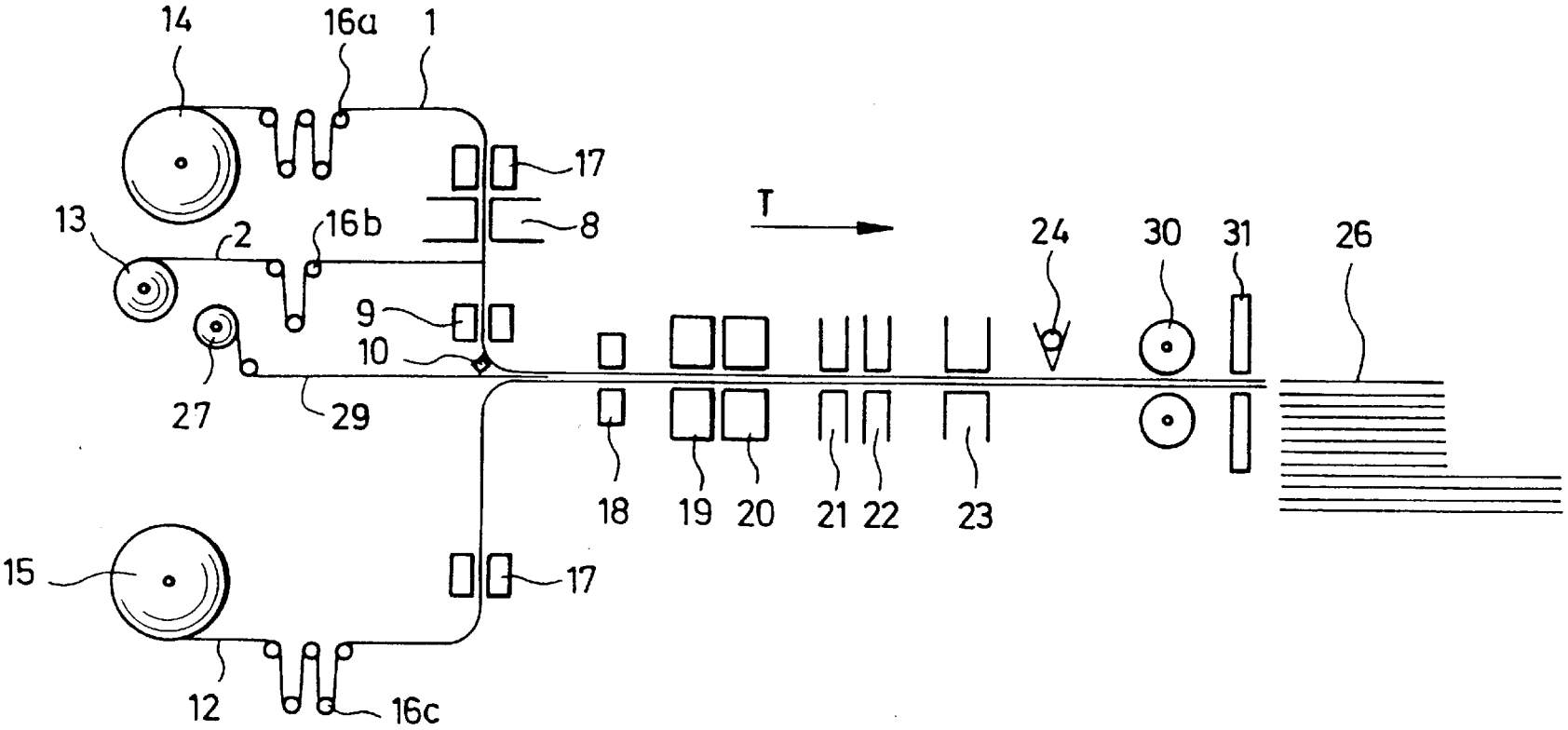

FIG. 1 shows in a schematic representation an apparatus for producing a beverage container as illustrated e.g. in FIGS. 4 and 5. The foils or sheetings necessary for making the beverage container are wound onto a front side sheeting supply roll 14, a closure sheeting supply roll 13, a bottom sheeting supply roll 27 and a rear side sheeting supply roll 15. With the aid of conveying rollers 30, the individual sheeting webs are each pulled from their respective supply rolls in conveying direction T. For enabling the individual sheeting webs to be conveyed in a tense condition, tension rollers 16*a*, 16*b* and 16*c* are disposed following the supply roll for the front side sheeting 14, the supply roll for the closure sheeting 13 as well as the supply roll for the rear side sheeting 15. A tension roller system, not shown, of course may be provided for the bottom sheeting as well. As seen in conveying direction T, the tension system 16*a* and 16*c* is followed by one length compensation means 17 each for the front side and rear side sheeting webs 1, 12. The length compensation means 17 for front side sheeting web 1 is followed in conveying direction T by a means 8 for producing a piercing hole 3 in front side sheeting web 1. The means 8 punches the piercing hole 3 (FIG. 5) completely through the front side sheeting web 1. In conveying direction T downstream of the tension system 16*b* for the closure sheeting web 2, the closure sheeting web 2 is fed via deflection rollers, not shown, to the front side sheeting web 1 and is guided parallel thereto. A first sealing means 9 is disposed around the front side and closure sheeting webs conveyed parallel to each other, in order to weld the closure sheeting web 2 around piercing hole 3, e.g. in circular manner, to the inside of front side sheeting web 1. An inspection means 10 is disposed downstream of the first sealing means 9 and monitors the function of the sealing means during the production in progress, so that the production of bags in which the piercing hole has not been correctly re-sealed is excluded. There may be provided deflection rollers, not shown in more detail, which feed the rear side sheeting web in conveying direction such that the inside of the front side sheeting web 1 welded to the closure sheeting web 2 moving along therewith faces the inside of the rear side sheeting web 12, and that the bottom sheeting web 29 is conveyed between front side and rear side sheeting webs 1, 12. After all sheetings have been fed together, they pass a sealing means 19 for the bottom sheeting web, which welds the bottom sheeting web in part to the front and rear side sheeting webs 1, 12 in the bottom region of the bag 28 to be produced, so that a standing bag can be formed, as shown e.g. in FIG. 4.

Downstream of the bottom sheeting sealing means 19 in conveying direction, there is provided a bottom cooling means 20 which cools the sealing sites. Downstream of the bottom cooling means 20, there is provided a sealing means 21 for the lateral edges 5 of the beverage container to be produced. At that location, the front side sheeting web and the rear side sheeting web are welded together along the lateral edges of the beverage container to be produced, with the closure sheeting web 2 being included therein. Following thereafter is a lateral edge cooling means 22 for cooling the sealed seams. Downstream of the lateral edge cooling means 22 there is provided a shape punching means 23 punching e.g. round beverage container corners to the welded together sheetings. The longitudinal cutter 24 disposed downstream thereof, in case of a plurality of beverage containers disposed beside each other perpendicularly to the conveying direction on the front and rear side sheeting webs 1, 12, is used for cutting the welded together sheeting webs into strips of bags which are joined together at the lateral edges 5 thereof. A transverse cutter 31 separates the lateral edges 5 of the individual bags from each other. In the present embodiment, the conveying means 30 is arranged between the longitudinal and transverse cutters 24, 31. Disposed down-stream of the apparatus is a bag packaging means 26 packaging the empty bags in stackable containers in fully automatic manner and transferring them to a conveyor, where they may be filled and closed thereafter.

It is of course not cogently necessary to supply the bottom sheeting web, but it is also possible to produce bags in which the front and rear side sheetings are simply welded together along the bottom edge 6*b* of the bag. Such an embodiment would be provided furthermore with a sealing means for welding together the front and rear side sheeting webs at the bottom edge of the bag, instead of the sealing means for the bottom sheeting web.

Conveying of the individual sheeting webs takes place in intermittent manner, i.e. the conveying means 30 moves on the respective sheeting webs each time by a certain distance which preferably corresponds to the width of one bag.

Due to the fact that the various supply rolls 14, 13, 27, 15 are connected to the same conveying means 30, synchronous transportation is guaranteed. There may be provided a means 18 for step monitoring, e.g. in the form of a photocell. In a preferred form, however, there is provided an additional conveying means, not shown, for the closure sheeting web that operates in synchronism with the first conveying means 30. This additional conveying means prevents excessive tensile stresses on the closure sheeting web 2. The individual stations 8, 9, 10, 19, 20, 21, 22, 23, 24, 31 are arranged in relation to each other such that, upon transportation of the respective sheeting webs by one indexing or cycle length, e.g. one bag width, a bag to be formed comes to lie in each station. This provides a continuous production operation which is not impaired by attachment of the closure sheeting web, either.

According to a concrete embodiment of the invention, it is also possible, as shown in FIG. 2, to provide a plurality of individual beverage containers to be produced, beside each other perpendicularly to the conveying direction T on the front and rear side sheetings 1, 12, respectively. In FIG. 2, for example, there are disposed, side by side, four beverage containers to be produced which are each adjoining each other with their upper and lower bag edges 6*a,b*. The production of the bag containers thus takes place on a machine with four uses, i.e. four beverage containers are produced simultaneously in one machine cycle.

As can be seen from FIG. 3, the front side sheeting web 1 is fed via deflection roller 7 to the means 8 for making the piercing hole in intermittent manner. At that location, there are four piercing holes 3 produced at the same time in front side sheeting web 1. The four closure sheeting webs are fed from four supply rolls 13 for the closure sheeting webs 2 via deflection rollers 32 to the front side sheeting web 1 in conveying direction, such that the closure sheeting webs 2 and the front side sheeting web 1 run parallel to each other. The four closure sheeting webs 2 and the front side sheeting web 1 are then conveyed to sealing means 9, with each closure sheeting web 2 being welded to the inside of front side sheeting web 1 around the respective piercing holes 3, e.g. in circular manner, thereby providing a sheeting arrangement as shown in FIG. 2. The front side sheeting web 1 having the four closure sheeting bands 2 welded around the piercing holes 3 is then conveyed to inspection means 10 so that the welds may be examined. The front side sheeting 1 having the closure sheetings 2 applied thereto is then advanced via a deflection roller 11, and a rear side sheeting web 12 is also advanced via a deflection roller 11 in conveying direction, such that the inside of front side sheeting web 1 faces the inside of rear side sheeting web 12. When beverage containers with separate bottom part are to be produced, four bottom sheeting webs may be conveyed in addition in conveying direction along arrow P between the front and rear side sheeting webs in the bottom region of each individual bag to be made, and may be sealed as described hereinbefore. Thereafter, the four beverage containers 28 each to be formed beside each other are welded together along their lateral edges 5, as has already been elucidated in conjunction with FIG. 1. The closure sheeting web 2 thus is not only held by the weld 4 around piercing hole 3, but at the same time is held by the welding seams at the lateral edges 5 of the beverage container. The welded together sheeting webs are then cut into separate beverage containers with the aid of longitudinal and transverse cutters 24, 31.

The closure sheeting web 2 does not have to be welded around piercing hole 3 in annular, angular etc. manner, but may also be welded to the front side sheeting web 1 across its entire area.

The individual bags are then transferred to a bag packaging means in order to be finally filled and closed completely.

I claim:

1. A method of making a beverage container, comprising the steps of forming a piercing hole in a front side sheeting web conveyed in a conveying direction, conveying a closure sheeting web in said conveying direction to said front side sheeting web, welding around said piercing hole to an inside of said front side sheeting web, supplying a rear side sheeting web in said conveying direction such that said inside of said front side sheeting web faces the inside of said rear side sheeting web, and welding together said front side sheeting web and said rear side sheeting web at least in part along the lateral edges of the beverage container to be produced, with said closure sheeting web being included therein.

2. A method of making a beverage container according to claim 1, including the steps of conveying a bottom sheeting web in said conveying direction between said front and rear side sheeting webs, and welding said bottom sheeting web in part to said front and rear side sheeting webs.

3. A method of making a beverage container according to claim 1, including the steps of providing a specific number of pairs of front side web portions and rear side web portions corresponding to a number of beverage containers to be produced on said front and rear side sheeting webs beside each other in a direction perpendicular to said conveying direction and, in accordance with said number of pairs of front side and rear side web portions, producing a corresponding number of piercing holes beside each other in said front side sheeting web, and supplying and welding a corresponding number of said closure sheeting webs around the respective said piercing holes.

4. A method of making a beverage container according to claim 3, including the step of, in conformity with the number of containers disposed beside each other supplying and welding a corresponding number of bottom sheeting webs respectively between said front and sheeting webs.

5. A method of making a beverage container according to claim 1, 2, 3, or 4, including the step of cutting the welded together said sheeting webs into separate beverage containers.

6. An apparatus for making a beverage container comprising in combination a conveying means for conveying a front side sheeting web, a conveying means for conveying a rear side sheeting web, means for producing a piercing hole through said front side sheeting web, a conveying means for conveying a closure sheeting web, a first sealing means for sealing said closure sheeting web to the inside of said front side sheeting web around said piercing hole, and a second sealing means for sealing said front side sheeting web and said rear side sheeting web at least in part, with said closure sheeting web being included therein.

7. An apparatus according to claim 6, and including a conveying means for conveying a bottom sheeting web and disposed such that said bottom sheeting web is conveyed between said front and rear side sheeting webs in a conveying direction, and a third welding means provided for welding said front and rear side sheeting webs at least in part to said bottom sheeting web.

8. An apparatus according to claim 6 or 7, and a transverse cutter provided for cutting the welded together said sheeting webs into separate containers.

9. An apparatus according to claim 6 wherein said front and rear side sheeting webs have a specific number of pairs of front side web portions and rear side web portions provided thereon beside each other in a direction perpendicular to said conveying direction, and, in conformity with this number, a corresponding number of said conveying means for said closure sheeting web and an equal number of said means for producing piercing holes, as well as an equal number of said first sealing means, are provided.

10. An apparatus according to claim 9, wherein, in conformity with the number of containers disposed beside each other, a corresponding number of said conveying means and third sealing means for said bottom sheeting webs are provided.

11. An apparatus according to claim 6, 7, 9, or 10, and including a longitudinal cutting means for cutting the beverage containers to be produced on the respective said sheeting webs beside each other.

12. An apparatus according to claim 6, 7, 9, or 10, wherein said first sealing means has an inspection means disposed downstream thereof for measuring the differential pressure so as to examine the weld around said piercing hole.

* * * * *

UNITED STATES PATENT AND TRADEMARK OFFICE

CERTIFICATE OF CORRECTION

PATENT NO. : 5,868,658

DATED : February 9, 1999

INVENTOR(S) : Rainer Wild

It is certified that error appears in the above-indentified patent and that said Letters Patent is hereby corrected as shown below:

In Claim 4, column 6, line 14, after "and" insert —rear side—.

Signed and Sealed this

Twenty-fifth Day of May, 1999

*Attest:*

Q. TODD DICKINSON

*Attesting Officer*

*Acting Commissioner of Patents and Trademarks*